United States Patent [19]

Woodhouse

[11] 3,941,138

[45] Mar. 2, 1976

[54] MACHINE FOR DISPENSING COINAGE CHANGE

[76] Inventor: John Carrick Woodhouse, 91 Nepean Highway, Mentone, Victoria, Australia, 3194

[22] Filed: June 10, 1974

[21] Appl. No.: 478,044

[30] Foreign Application Priority Data

June 8, 1973 Australia ..... 3589/73

[52] U.S. Cl. ..... 133/2; 194/63; 221/253

[51] Int. Cl.[2] ..... G07D 1/06

[58] Field of Search ..... 194/24–26, 194/37, 38, 48, 57, 63, 75, 79, DIG. 20, 85, 88, DIG. 16; 221/93, 95, 107, 253, 266; 133/2, 4–7, 4 R

[56] References Cited

UNITED STATES PATENTS

| | | | |
|---|---|---|---|
| 821,761 | 5/1906 | Stanley | 194/DIG. 16 |
| 1,175,357 | 5/1916 | Jaeger | 194/25 |
| 1,224,942 | 5/1917 | Lorentzen | 194/93 |
| 1,593,825 | 7/1926 | Higgens, Jr. | 221/107 |
| 1,967,114 | 7/1934 | Cutler | 194/93 |
| 3,167,078 | 1/1965 | Trautenberg | 194/10 |

FOREIGN PATENTS OR APPLICATIONS

| | | | |
|---|---|---|---|
| 193,854 | 9/1906 | Germany | 133/4 R |

*Primary Examiner*—Drayton E. Hoffman
*Assistant Examiner*—H. Grant Skaggs
*Attorney, Agent, or Firm*—Cushman, Darby & Cushman

[57] ABSTRACT

A machine for dispensing coinage change including a conveyor in the form of a belt or plate and including rows of coin receiving apertures or recesses with a mechanism to advance the conveyor means forward in response to a manually operated coin actuated drive mechanism, with the conveyor being advanced beneath a plurality of supply tubes adapted for alignment with corresponding rows of apertures or recesses in the conveyor and extending in the direction of motion of the conveyor. Coinage change is collected from an advanced supply tube only after a supply tube trailing the advanced tube in a particular row of tubes fails to deliver a coin. The conveyor feeding a transfer chute through which coinage change collected by the conveyor gravitates for collection by the operator of the machine. The conveyor is held against forward movement if any one of the rows of apertures or recesses in the conveyor reaches the transfer chute without a coin in the aperture or recess at the point of discharge into the supply chute.

13 Claims, 7 Drawing Figures

MACHINE FOR DISPENSING COINAGE CHANGE

Figure 1:
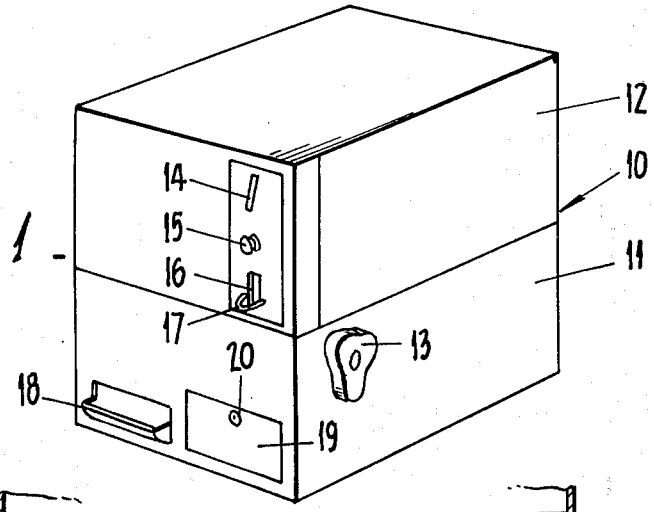

This invention relates to a machine for dispensing coinage change, which machine is of the type where upon insertion of a coin of a predetermined value a pluralilty of coins of lesser value, but preferably collectively equivalent to the value of the coin inserted, will be dispensed.

Machines of this type are commonly used at locations where change may be required to operate adjacent machines, but where facilities and personnel for providing change are not, or at certain times are not, available.

Machines to automatically dispense coinage change have been developed, and such machines have utilized an oscillating plate adapted to be moved back and forth, in response to a coin actuated drive mechanism, beneath a plurality of delivery tubes spaced apart across the plate. Coins gravitate from the delivery tubes into recesses in a holding plate beneath which the oscillating plate moves. When like recesses in the oscillating plate align with the recesses in the holding plate they collect the coins from the holding plate and deliver the coins to a delivery chute from which the user of the machine can collect the change.

As an example, it may be required to dispense four 5 cent pieces as change for a 20 cent piece. The user of the machine delivers the 20 cent piece to the machine. The 20 cent piece passes through a rejection section of the machine, which section is designed to reject coin shaped articles which are delivered to the machine which do not exhibit the necessary size, weight and in some cases material, characteristics for which coinage the machine is adapted to receive. Upon a coin being received as legitimate coinage, the oscillating plate is actuated and moves forward to collect and deliver coinage change, which has previously gravitated into the recesses in the holding plate. In the example given when four 5 cent pieces are to be delivered as change for a 20 cent piece, four coin delivery tubes are provided spaced apart across the direction of motion of the oscillating plate, and each tube supports a column of 5 cent pieces. The tubes will therefore deliver four 5 cent pieces to the oscillating plate, via the holding plate, each time the oscillating plate is advanced for simultaneous dispensing to a collection chute.

The major disadvantage with such machines known to date has been associated with the frequency of replenishment of the delivery tubes with change coinage. In order to reduce the frequency of replenishment the delivery tubes have had to be made relatively long to carry a convenient supply of coinage, thus resulting in an increase in the size, particularly height, of the machine.

It is therefore an object of the present invention to provide a machine for dispensing coinage change which maintains a relatively convenient amount of coinage change available for dispensing without the necessity for relatively long delivery tubes.

The invention therefore envisages a machine for dispensing coinage change, including means to receive a coin for which change is required, means operative in response to the receipt of said coin to advance a conveyor means beneath a plurality of change coinage supply tubes and means adapted to receive and deliver change from said conveyor means, wherein there is at least one row of supply tubes extending in the direction of motion of said conveyor means, each row containing a plurality of said supply tubes, said conveyor means being adapted to collect coinage from an advanced supply tube only after a supply tube trailing said advanced tube, in a particular row of tubes, fails to deliver a coin for collection by said conveyor means.

Preferably there are a plurality of rows of supply tubes spaced apart transversely of the direction of motion of said conveyor means.

Preferably according to one embodiment of the invention said conveyor means is a conveyor belt or chain including a plurality of rows of pockets, or like recesses, spaced apart across said belt or chain, with the upper edge of each said pocket, or like recess, lying in a plane closely adjacent the bottom of said supply tubes, whereby the presence of a coin in said pocket, or like recess, will preclude the delivery of a coin from an associated supply tube.

In an alternative embodiment the conveyor means may be a rotatable plate member including a plurality of pockets, or like recesses, extending through said plate member and in one, or more, rows around the axis of rotation of said plate member, each row being at a predetermined radius from the axis of rotation, with the upper edge of each pocket, or like recess, lying in a plane closely adjacent the bottom of a corresponding arrangement of supply tubes, whereby the presence of a coin in said pocket, or like recess, will preclude the delivery of a coin from an associated supply tube, and a fixed retaining plate member parallel to and in sliding engagement with said rotatable plate member for retaining said coins in said pockets, or like recesses, and including a cut-away section to allow said coins to be removed from said pockets, or like recesses, upon them being aligned with said cut-away portion.

By providing rows of supply tubes, the height of the tube can be reduced whilst the capacity of a single relatively large supply tube is retained, without resulting in an inconveniently large overall height for the machine.

The provision of pockets, or like recesses, on the conveyor means closely adjacent the bottom of the tubes allows all coinage to be dispensed from an immediately adjacent trailing tube before a tube in advance of it is met by a vacant pocket or recess into which it can commence to deliver coinage.

A vacant pocket or recess may still be produced even if the trailing tube is not empty should per chance a coin stick or jam within the supply tube and be prevented from being deposited in the recess or pocket on the conveyor means.

Preferably in the case of a conveyor belt or chain, the pockets or recesses are provided by a plurality of ridges extending transversely of the belt and spaced apart along the belt beneath the delivery tubes. The width of the ridges determines the size of the recess provided between each ridge and thus the size of the coin which the particular row of recesses is adapted to receive. In machines where the change is to be dispensed in coinage of varying denominations the size of the recess provided by the ridges in selected rows is adapted to match the coinage to be supplied by the supply tubes in that row.

In the case of a rotating circular disc, the pockets or recesses in one particular circumferential row are of such a size as to accomodate the particular coinage for that row, and the larger coinage pockets will normally be provided in the radially outermost row.

Preferably the means adapted to advance the conveyor means in response to the receipt of a coin delivered to the machine is a drive shaft adapted for operation from outside the machine to advance the conveyor means through one advanced step or predetermined distance, via a drive mechanism, which mechanism is freed to operate by a locking mechanism adapted to unlock upon receipt of a coin delivered to the machine, but adapted to lock said drive mechanism after siad predetermined distance has been advanced by said conveyor means.

Another problem associated with known machines, is the provision of a convenient, uncomplicated mechanism for indicating that no change is available in the machine, and to prevent coinage for which change would be required from being delivered into the machine.

It is therefore a further preferred, but not essential, aspect of the present invention to include a mechanism for readily sensing that no change is available in the machine for dispensing, and to prevent the user from inserting coinage in the machine whilst change is not available.

Therefore preferably the inventive machine also includes a stop rod biased towards a position against the coins in a particular row on the conveyor means just prior to the point of delivery from said conveyor means, whereby upon an empty pocket or recess passing beneath said stop rod the rod will move through an aperture in said pocket, or recess, under the action of its biasing means to, by means of an associate linkage system, close a coin entry aperture to the machine.

Preferably the stop rods are biased toward the conveyor means by virtue of their own weight and additional weight members. Alternatively the push rods may be spring biased.

Preferably at the base of each recess a passage is provided extending partially, or completely, through the conveyor means into which aperture the push rod moves to jam the conveyor means against any further advance motion.

When such "no change" provision is made it is necessary that at least one line of coinage change across the direction of motion of the conveyor means be provided between the supply tube and the point of discharge from the conveyor means to allow for the no change mechanism to anticipate the absence of change in the pocket at the discharge point of the conveyor means.

Figure 4:
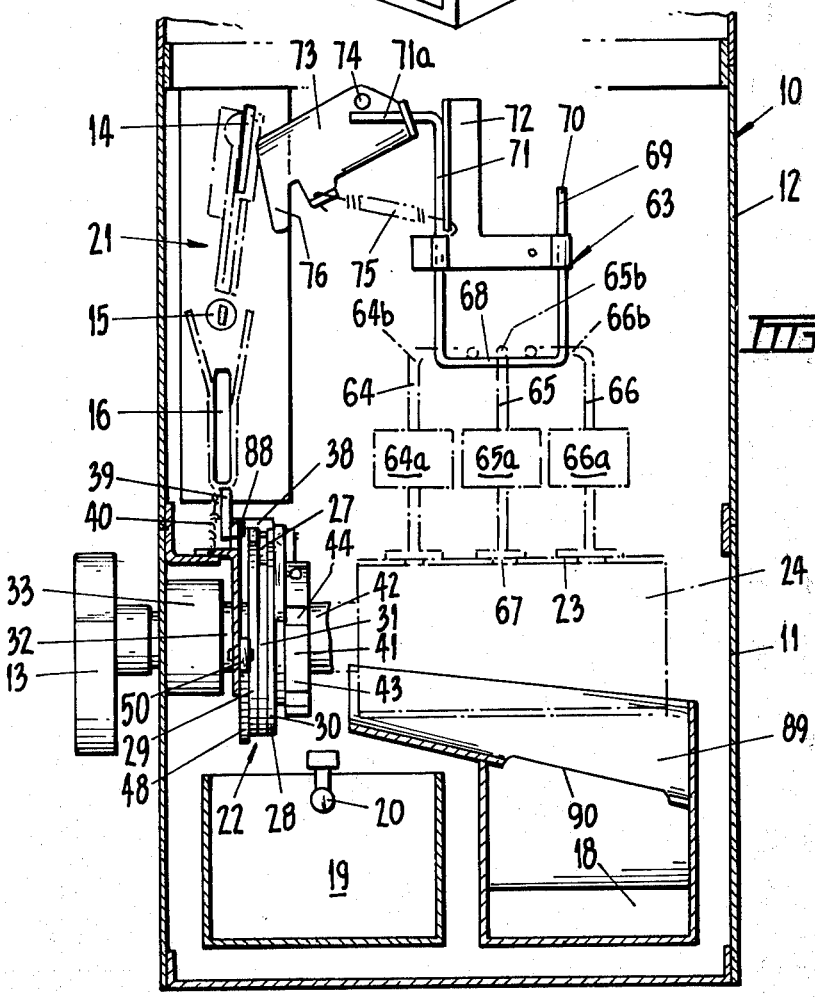
Figure 2:
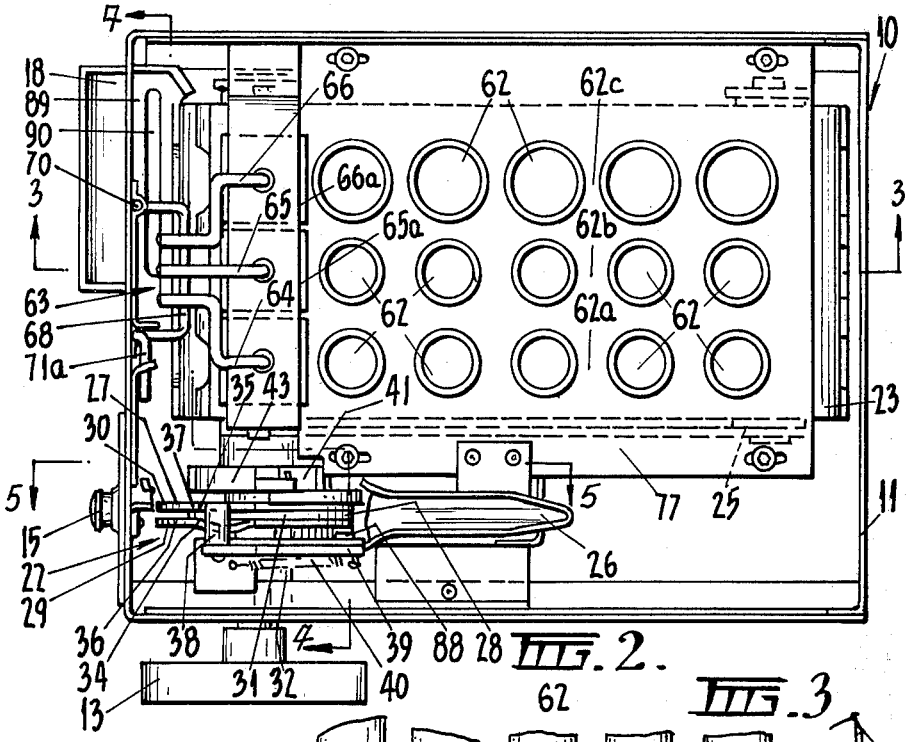
Figure 3:
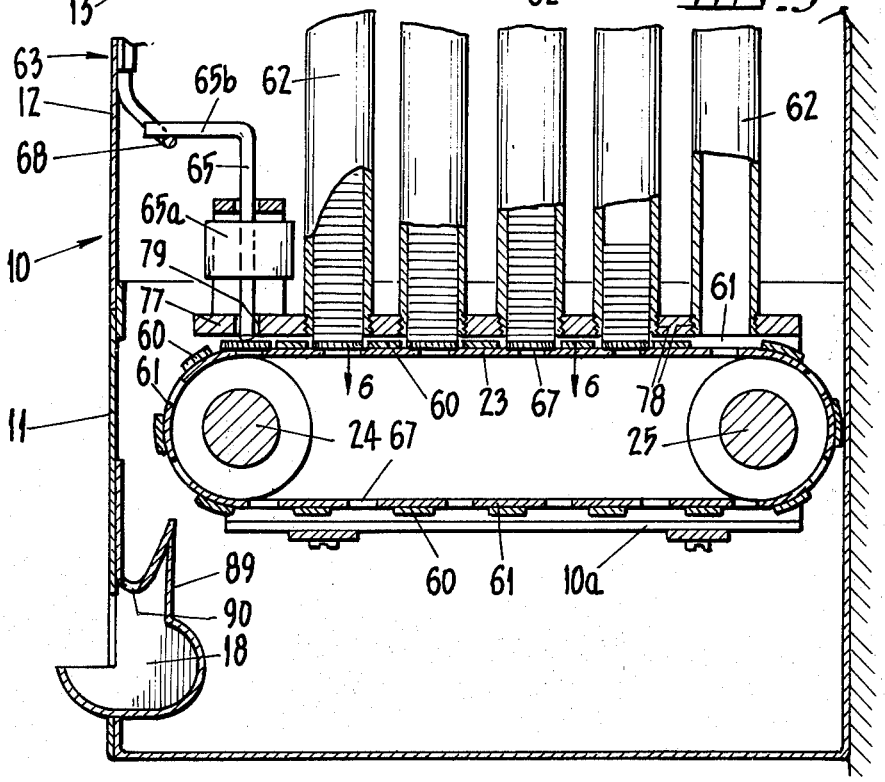
Figure 5:
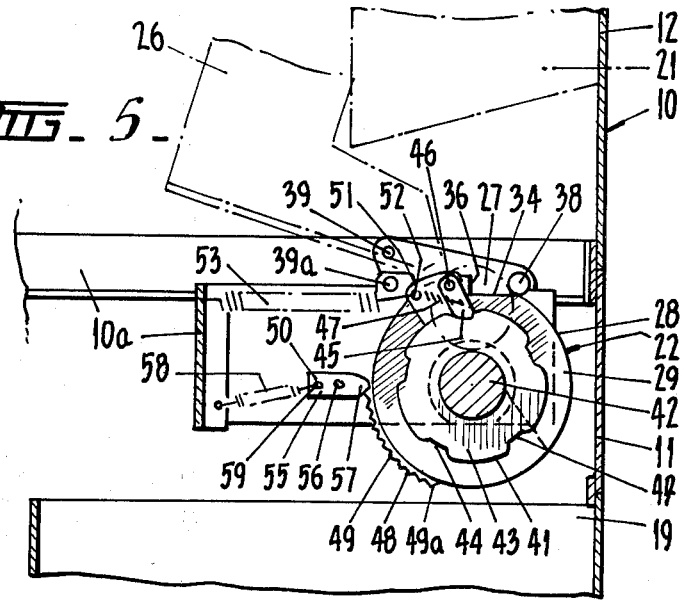
Figure 6:
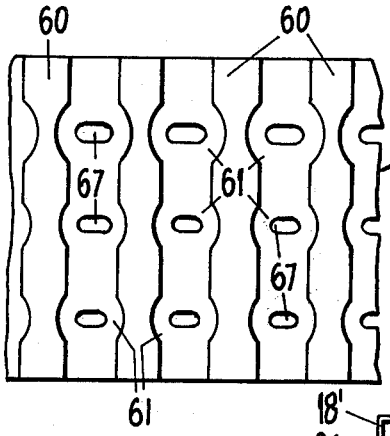
Figure 7:
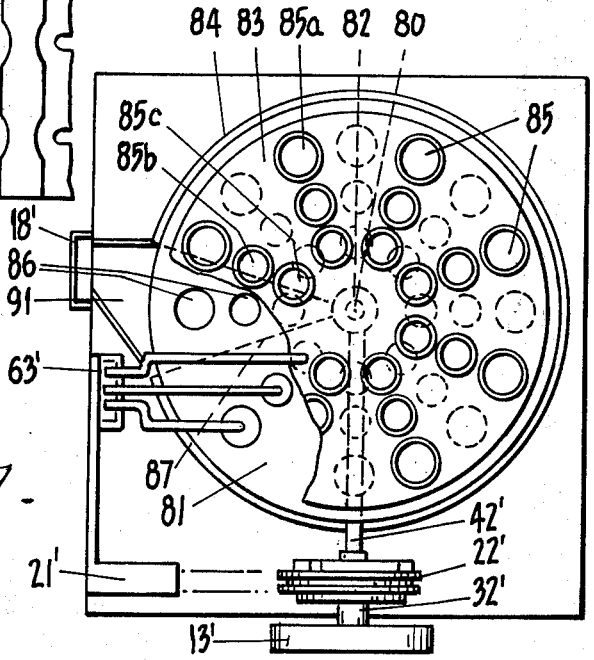

Two preferred forms of the invention will now be described with reference to the accompanying drawings in which:

FIG. 1 is a general perspective view of one preferred form of machine according to the present invention, FIG. 2 is a plan view of the machine of FIG. 1 with the top removed to show the mechanism inside, FIG. 3 is a side elevational view taken along line 3—3 of FIG. 2, FIG. 4 is an end elevational view taken along line 4—4 of FIG. 2, FIG. 5 is a side elevational view of part of the mechanism of FIG. 2, taken along line 5—5 of FIG. 2, FIG. 6 is a view of portion of the conveyor belt used in the mechanism of the machine of the embodiments of FIGS. 1 to 5 as viewed in the direction of arrow 6—6 of FIG. 3, and FIG. 7 is a plan sectional view of an alternative for section of the mechanism of the embodiments of FIGS. 1 to 6.

In the first embodiment of the invention as illustrated in FIGS. 1 to 6, and in particular in FIG. 1, the machine comprises a housing generally indicated as 10 including an inner frame **10*a* for supporting various parts of the mechanism within the housing, a lower section 11, and an upper removable section 12**, to allow access to the mechanism within the housing and including provision (not shown) for locking the upper section in position to prevent unauthorized access to the interior of the housing.

An operating knob 13 extends through one side wall of the housing 10 for actuation by a user of the machine, whilst the upper section of the front wall of a housing includes a coin receiving slot 13, a reject button 15 to allow a coin rejected by the machine to be returned to the user through a coin return slot 16 and against a retaining bar 17. Various types of mechanisms for receiving coinage for passing on to allow subsequent operation of dispensing type machines, or for rejecting and returning non-legitimate or damaged coinage, are well known in the art and thus such a form of mechanism with which slot 14, reject button 15 and return slot 16 cooperate will not be described in detail.

The front wall also includes a collection chute 18 for which coinage change is dispensed by the machine for collection by the user and a drawer 19 having a lock 20 into which coins delivered and accepted by the machine accumulate for subsequent collection by the servicing authority.

The machanism within the housing 10 according to this embodiment includes a coin receiving and rejection section generally indicated as 21, adapted to cooperate with a drive mechanism, generally indicated as 22, for an endless conveyor belt 23 driven about pulleys 24 and 25 at either end of the machine. As stated above the coin receiving and rejection section 21 will not be described in detail as such devices are well known, but basically include provision for rejecting coins, or an allege substitute for a coin, which are overweight without delivering the coin to a position allowing actuation of the mechanism of the machine. On the other hand if a light coin, or an allege substitute for a coin, is inserted, it will also be rejected and not allow actuation of the mechanism for the machine. Any coin of a correct weight and size will be delivered to the drive mechanism 22 enabling the drive motion to be transmitted through to the conveyor belt 23 in a manner to be later described. Some parts of coin receiving and rejection devices also include facility for sensing the delivery of metal disc substitute for coins and rejecting such a substitute, for example, a magnet for intercepting substitutes in the form of discs of magnetic material.

Once a coin has been accepted by the coin receiving and rejection section 21 as legitimate or undamaged coinage, it will be passed to supply chute 26 (see FIGS. 2 and 5) down which it will roll into a coin receiving cavity 27 forming part of a locking section 28 of the drive mechanism 22.

The locking section 28 includes a pair of spaced discs 29 and 30 attached to a spacer member 31 which in turn is fixed to a drive shaft 32. The drive shaft 32 extends outwardly through the side wall of the housing 10 via an overload clutch mechanism 33 to where the operating knob 13 is fixedly attached thereto. The overload clutch mechanism 33 will not be described in detail and is merely a clutch arrangement to prevent the mechanism from being strained or overloaded should any part of the mechanism of the machine jam.

Opposed circumferential portions of the discs 29 and 30 include cut-away sections 34 and 35 forming abutments 36 and 37 adjacent the coin receiving cavity 27 at this point. A pin 38 mounted on a lever 39 pivotally supported at 39*a* on the inner frame 10*a* is biased by means of a coil tension spring 40 against the circumferential edges of the discs 29 and 30 in bridging relationship thereto. When there is no coin in the coin receiving cavity 27, and an attempt is made to rotate the operating knob 13, such as to rotate the drive shaft 32 in the clockwise direction as shown in FIG. 5, the pin 38 contacts the abutments 36 and 37 to prevent rotation of the shaft 32 and thereby rotation through the drive mechanism 22 of a driven shaft 42 for the front drive pulley 24 attached thereto, and as such prevents forward motion of the conveyor belt 23.

With a coin in the coin receiving cavity 27 as shown in phantom in FIG. 5, the pin 38 will engage the curve circumference of the coin as the shaft 32 is rotated by the operating knob 13 in the clockwise direction and will ride over the curve circumference of the coin to allow the discs 29 and 30 to rotate beneath the pin 38 and thereby allow the shaft 32 to rotate in the clockwise direction as shown in FIG. 5 (anticlockwise as viewed in the direction of FIG. 3). The driven shaft 42 for the front drive pulley 24 has its end adjacent the locking section 28 journalled and supported within the locking section 28 to be coaxial, and coextensive, with the drive shaft 32 but capable of rotation independently thereof.

Drive rotational motion is transferred from the drive shaft 32 via the locking section 28 to the driven shaft 42 by means of a drive clutch mechanism 41 comprising a clutch plate 43 having formed in the circumferential edge thereof a plurality of notches 44, and fixed with respect to the driven shaft 42. A pawl member 45 is pivotally attached at 46 to the side of the adjacent disc 29 of the locking mechanism 28 and its free end engages in one of the notches 44 under the action of a biasing spring 47 (see FIG. 5) such that upon rotation of the disc 29 the clutch plate 43 will be forced to rotate in the same direction by virtue of the driving force applied by the pawl member 45 against the leading side of the notch 44 for a distance approximately equivalent to the circumferential distance between adjacent notches 44. The driven shaft 42 will likewise rotate the predetermined amount as will the front drive pulley 24 and thus the conveyor belt 23 will be advanced a predetermined distance.

In order to limit the amount of rotation of the mechanism an arcuate tooth member 48 is attached to the circumference of the disc 30 and carries on the arcuate edge thereof a series of teeth 49 (see FIG. 5). During rotation of the member the teeth 49 move past a non return mechanism 50 (to be later described) and after completely passing the non return mechanism 50 the leading tooth contacts a stop member 88 fixed with respect to the frame 10*a* of the machine to prevent further rotation of the mechanism. In the embodiment illustrated the mechanism will have rotated through approximately 70° which is sufficient to allow the conveyor belt 23 to move forward a predetermined distance to deliver one set of coinage change, whilst the coin receiving cavity 27 will have reached a position whereby the coin therein will fall thereof into the collection draw 19.

The disc 29 carries a support member 51 upon which pawl member 45 is pivotally supported at 46 and provides a pin 52 (see FIG. 5) for attachment of the biasing spring 47 for the pawl member 45. The pin 52 also has attached thereto one end of a main tension coil spring 53 (see FIG. 5) the other end of which is fixed to the frame 10*a* of the machine. During rotation of the mechanism the main spring 53 stretches and upon release of the rotational pressure on the operating knob 13 the main spring 53 returns the locking section 28, drive shaft 32 and knob 13 to the original position. The clutch plate 43, and thus the driven shaft 42 and conveyor belt 23 remain at the advance position whilst the pawl member 45 on the locking section 28 moves over the circumferential edge of the clutch plate 43 to latch in the trailing groove 44 ready for the next actuation of the mechanism.

The non-return mechanism 50 is provided to prevent reversal of the rotation of the mechanism whilst the tooth member 48 passes the mechanism 50 and reaches the stop member 88. Such a mechanism 50 prevents stopping of the rotation of the mechanism at a point during rotation movement, for example, towards the end thereof and returning the mechanism back to the start thereby allowing a plurality of advances of the belt and delivery of coinage change for the deposit of only one coin by the user of the machine.

The non-return mechanism 50 (see FIG. 5) comprises a pawl member 55 pivoted about an axis 56 and having a wedge shaped end 57 adapted to engage the teeth 49 of the tooth member 48. A biasing coil spring 58 is provided between an attachment pin 59 on the opposite end of the pawl member 55 and the frame 10*a* of the machine. The biasing spring 58 tends to bias the wedge shaped end 57 of the pawl member 55 upwardly as shown in FIG. 5 such that when engaged between adjacent pairs of teeth 49 on the tooth member 48 during rotation of the mechanism, the upward orientation of the wedge shaped end 57 will prevent reversal of rotation of the mechanism. Upon the tooth member 48, and therefore all its teeth 49, passing the wedge shaped end 57 of the pawl member 55 reversal of rotation can then be accomplished as the end face of the normally trailing tooth 49*a* will push the pawl member 55 aside against the action of the spring 58 to allow the teeth 49 on the tooth member 48 to return back past the non return mechanism 50.

As described above the drive mechanism 22 cooperates with the front drive pulley 24 of the conveyor belt 23 such that the belt will be advanced, upon actuation via the operating knob 13, one predetermined unit of advanced distance.

The conveyor belt 23 is in the form of a continuous belt around the two end pulleys 24 and 25. Spaced apart along the length of the belt 23 in rows extending transversely to the direction of motion of the belt 23 are a plurality of ridges 60 which provide between adjacent ridges a plurality of spaced coin receiving pockets or recesses 61. The size of the pocket or recess 61 in one row longitudinally of the belt determines the size of the coin adapted to be received by that particular row on the belt.

Positioned above the belt 23 to extend upwardly away therefrom are a plurality of rows of coin supply tubes 62 holding the change coin to be dispensed. For example, as shown, there are three rows of supply tubes with five supply tubes in each row. The size of the tube 62 for each row and the size of the recess 61 adjacent said row, are determined according to the value of the coinage to be dispensed by each row. In the case of a machine designed to dispense two 5 cent pieces and one 10 cent piece as change for one 20 cent piece, two of the rows 62*a* and 62*b* include supply tubes and their associated recesses are of a predetermined size for the receipt of 5 cent sized coins, whilst the remaining row of supply tubes 62*c* and their associated recesses 61 are of a predetermned size for the receipt of 10 cent pieces.

As previously discussed, coins are collected from the back or trailing supply tube 62 in each row, and coins are prevented from being delivered to the belt 23 from an advance supply tube in such row by the existence of coins in the pockets or recesses 61. Once the trailing delivery tube 62 is empty, or a coin jams in the tube, the associated recess 61 is still empty after passing thereunder and thus coinage will commence to be successively delivered by the next adjacent supply tube 62 in the row and so on.

As an alternative example, change of one 5 cent piece, two 2 cent pieces and one 1 cent piece could be supplied as change for a 10 cent piece by providing one row of supply tubes 62 and associated recesses 61 adapted to deliver 5 cent pieces, two rows similarly adapted to deliver 2 cent pieces and one row adapted to deliver 1 cent pieces. Any combination of coinage values for change can be readily envisaged and the supply tubes 62 and recesses 61 in the belt 23 adapted accordingly for the particular application involved.

In order to prevent use of the machine in a "no change" situation, at least one row of coins extending across the belt must be left between the leading or forwardmost supply tubes and the actual point of delivery from the belt as shown in FIG. 3.

An anticipatory "no change" sensing mechanism, generally indicated as 63 is provided adjacent this transverse row, and consists of row of stop rods 64, 65 and 66 biased either under their own weight, or under the action of spring, or by the addition of weight members 64*a*, 65*a*, and 66*a* as shown, toward positions inwardly of the surface of the conveyor belt 23 with one rod being provided adjacent each row in the conveyor belt. Each pocket or recess 61 in the conveyor belt 23 includes an aperture 67 therethrough. Whilst coins are received in all pockets 61 of the transverse row adjacent the delivery chute the stop rods are all prevented from falling through the aperture 67 in the belt by the presence of the coins in the pockets or recesses 61. When at least one of the pockets or recesses 61 is empty when it reaches this position, the associated stop rods 64, 65 or 66 moves into and through the associated aperture 67 in the belt 23 to jam the conveyor belt 23 against further forward movement. The upper end 64*b*, 65*b* and 66*b* of the push rods engage over the top of the horizontal connecting position 68 of a U-shaped actuating member 69 the leg portions 70 and 71 of which are retained for vertical movement within a support bracket 72. One end 73 of one of the leg portion 71 engages a closure plate 73 (see FIG. 4) pivotally supported as 74. In the position shown in FIG. 4 the closure plate 73 is held in a position shown by tension coil spring 75. Should one of the rows of recesses 61 be empty and the associated stop rod 64, 65 or 66 is thereby allowed to move down through the associated aperture 67 the upper end 64*b*, 65*b* or 66*b* engaging the connecting portion 68 of the U-shaped actuating member 69 pulls the actuating member 69 downwardly, the closure plate 73 pivots about the pivot axis 74 against the action of the tension spring 75 and an end portion 76 thereof moves upwardly to close the entrance of the coin receiving slot 14 to prevent a coin being inserted.

As illustrated the supply tubes 62 are supported above the upper run of the conveyor belt 23 at their lower ends in a support plate 77 (see FIG. 3) by virtue of threaded connections 78 as shown, and the support plate 77 may be extended as shown to provide guide apertures 79 for the stop rods 64, 65 and 66.

Each supply tube 62 may have a slightly greater diameter at a point about 1 inch above the lower delivery end thereof to facilitate replenishment thereof with full tubes of coins when required.

As an alternative to a belt with pockets, recesses or the like a fixed plate may be provided with longitudinal slot therein aligned with each row of delivery tubes and separated by longitudinally extending ridges. The belt is adapted to move directly beneath the plate and carries a plurality of longitudinally spaced rows of projections aligned with the slots in the plate above. As the belt moves beneath the plate the projections successively move into and along the slots in the plate with their tips slightly above the surface of the plate to collect coins and carry them along the plate to be subsequently delivered in groups to the delivery chute.

For each advancement of the belt 23 by the drive mechanism 22, the distance moved is such that coins in all recesses 61 will move on the belt from the position adjacent the transverse row beneath the "no change" sensing mechanism a distance sufficient to fall of the end of the belt 23 into a transfer chute 89, through a transfer passage 90 and into the collection chute 18.

In a further alternative embodiment as shown in FIG. 7 the housing, operating knob 13', a coin receiving and rejection section 21', a drive mechanism 22' with drive and driven shafts 32' and 42', no change sensing mechanism 63' and delivery chute 18' are generally the same as described and illustrated with reference to FIGS. 1 to 5, and the modification of this alternative embodiment resides in an alternative to the conveyor belt 23 as previously described. In this alternative embodiment the driven shaft 42' instead of driving a front pulley for a conveyor belt drives a vertical shaft 80 for rotating a horizontally disposed apertured plate 81 via a bevel gear arrangement 82. The apertured plate 81 is sandwiched for rotation between an upper supply tube supporting plate 83 and a lower retaining plate 84 both of which are fixed against rotation. The upper supply tube supporting plate 83 carries a plurality of upwardly extending supply tubes 85 the lower ends of which are threadably received within threaded holes in the plate 83. In the illlustrated embodiment the circumferentially extending rows of supply tubes 85 are provided such that tubes in adjacent rows extend radially outwardly to be spaced apart. The outer row 85*a* may be adapted to contain larger coinage, and the inner rows 85*b* and 85*c* smaller, or progressively smaller, coinage. The rotatable apertured plate 81 includes rows of apertures 86 adapted to align with respective rows of supply tubes to collect coinage therefrom. The lower retaining plate 84 retains coins in the apertures 86 until they align with a wedge shaped cut away section 87 in the lower retaining plate 84 at which point the coins will fall through the cut away portion 87 into a transfer passage 91 and then to the delivery chute 18'.

In FIG. 7 with the direction of rotation of the apertured plate 81 being in the clockwise direction the radially spaced supply tubes 85 in each row adjacent the cut away portion 87 represents the trailing tubes for each row 85*a*, 85*b* and 85*c* and will deliver coins to the apertures 86, whilst the presence of coins in the apertures 86 from then on will prevent delivery of coins from leading tubes 85 until the trailing tubes are empty at which time the next spaced supply tube in the relevant row 85*a*, 85*b* or 85*c* in the clockwise direction will deliver coins to the appropriate apertures.

If any of the circumferential rows 85*a*, 85*b* or 85*c* of tubes 85 should fail to deliver a coin due to being empty or due to jamming of a coin in the tube, the stop rod section of the "no-change" mechanism 63' will operate in the same manner as described previously should an empty aperture 86 reach the point prior to the cut away portion 87 in the retaining plate to jam the mechanism against rotation and close the coin delivery slot.

If desired, and in the event that the mechanism of the machine should malfunction after having accepted a coin supplied thereto, a separate supply of coins of the value equivalent to that fed to the machine may be provided and cooperate with the mechanism such that if a coin is accepted but the mechanism does not complete a delivery motion, actuation of the reject button, or an alternative button, will allow a coin of equivalent value to that supplied to the machine to be delivered to the supply chute. Such a mechanism may be adapted to only allow delivery of a coin in return should the machine malfunction.

In certain situations the apparatus of this invention may cooperate with a machine normally adapted to receive coins in payment for good or services, and the coins used in that apparatus may continuously replenish the change section of the machine, that is, coins received are automatically sorted if necessary, and then fed through delivery chutes to the supply tubes in each row in the change delivery machine. A typical situation for such an application is a telephone call box where change for use in making a call can be obtained from the machine, and the coinage fed for making the call will be used to at least partially replenish the supply tubes.

I claim:

1. A machine for dispensing coinage change, including means for receiving a coin for which change is required, means operative in response to the receipt of said coin for advancing a conveyor means beneath a plurality of change coinage supply tubes, and means adapted to receive and deliver change from said conveyor means, wherein there is at least one row of supply tubes extending in the direction of motion of said conveyor means, each row containing a plurality of said supply tubes, said conveyor means including at least one row of recesses adapted to collect coinage from an advanced supply tube only after a supply tube trailing said advanced tube, in a particular row of tubes, fails to deliver a coin for collection by said conveyor means, the upper edge of each of said recesses lying in a plane proximate the bottom of said supply tubes, whereby the presence of a coin in said recess will preclude the delivery of a coin from an associated supply tube, and wherein a sensing mechanism is provided including at least one stop rod biased toward a position against the coin in a particular row on the conveyor means just prior to the point of delivery from said conveyor means, whereby upon an empty recess passing beneath said stop rod the rod will move through an aperture in said recess under the action of its biasing means to close, by means of an associated linkage system, a coin entry aperture to the machine and at the same time jam the conveyor means against further advanced movement.

2. A machine as claimed in claim 1, wherein there are a plurality of rows of supply tubes and recesses spaced apart transversely of the direction of motion of said conveyor means.

3. A machine as claimed in claim 1, wherein the recesses are provided between a plurality of ridges extending transversely of the conveyor means and spaced apart along the conveyor means adjacent the bottom of said supply tube, with said recesses being provided between adjacent ridges and being capable of receiving a coin of predetermined size.

4. A machine as claimed in claim 1, wherein the means adapted to advance the conveyor means in response to the receipt of a coin delivered to the machine is a drive shaft adapted for operation from outside of the machine to advance the conveyor means through one step of predetermined distance via a drive mechanism, which mechanism is freed to operate by a locking mechanism adapted to unlock upon receipt of a coin delivered to the machine, and adapted to lock said drive mechanism after said predetermined distance has been advanced by said conveyor means.

5. A machine as claimed in claim 1, wherein the stop rods are biased toward the conveyor means by virtue of their own weight and additional weight members.

6. A machine for dispensing coinage change, including means for receiving a coin for which change is required, means operative in response to the receipt of said coin for advancing a conveyor means beneath a plurality of change coinage supply tubes, and a means adapted to receive and deliver change from said conveyor means, wherein there is at least one row of supply tubes extending in the direction of motion of said conveyor means, each row containing a plurality of said supply tubes, said conveyor means being adapted to collect coinage from an advanced supply tube only after a supply tube trailing said advanced tube, in a particular row of tubes, fails to deliver a coin for collection by said conveyor means and wherein a sensing mechanism is provided including at least one stop rod biased towards a position against the coin in a particular row on the conveyor means just prior to the point of delivery from said conveyor means, whereby upon an empty recess passing beneath said stop rod, the rod will move through an aperture in said recess under the action of its biasing means to close, by means of an associated linkage system, a coin entry aperture to the machine and at the same time jam the conveyor means against further advanced movements.

7. A machine as claimed in claim 6, wherein the stop rods are biased toward the conveyor means by virtue of their own weight and additional weight members.

8. A machine as claimed in claim 6, wherein there are a plurality of rows of supply tubes spaced apart transversely of the direction of motion of said conveyor means.

9. A machine as claimed in claim 6, wherein said conveyor means includes a plurality of rows of recesses spaced apart across said conveyor means, with the upper edge of each recess lying in a plane proximate the bottom of said supply tubes, whereby the presence of a coin in said recess will preclude the delivery of a coin from an associated supply tube.

10. A machine as claimed in claim 9, wherein the recesses are provided between a plurality of ridges extending transversely of the conveyor means and spaced apart along the conveyor means adjacent the bottom of said supply tube, with said recesses being provided between adjacent ridges and being capable of receiving a coin of predetermined size.

11. A machine as claimed in claim 6, wherein said conveyor means is a rotatable plate member including a plurality of recesses extending through said plate member and in one, or more, rows around the axis of rotation of said plate member, each row being at a predetermined radius from the axis of rotation, with the upper edge of each recess lying in a plane closely adjacent the bottom of a corresponding arrangement of supply tubes, whereby the presence of a coin in said recess will preclude the delivery of a coin from an associated supply tube, and a fixed retaining plate member parallel to and in sliding engagement with said rotatable plate member for retaining said coins in said recesses, and including a cut-away section to allow said coins to be removed from said recesses upon their being aligned with said cut-away portion.

12. A machine as claimed in claim 11, wherein the recesses in a particular row are capable of accommodating the particular coinage for that row, with recesses for larger coinage normally being provided in radially outermost rows.

13. A machine as claimed in claim 6, wherein the means adapted to advance the conveyor means in response to the receipt of a coin delivered to the machine is a drive shaft adapted for operation from outside of the machine to advance the conveyor means through one advanced step of predetermined distance via a drive mechanism, which mechanism is freed to operate by a locking mechanism adapted to unlock upon receipt of a coin delivered to the machine, and adapted to lock said drive mechanism after said predetermined distance has been advanced by said conveyor means.

* * * * *